United States Patent [19]

Foisie

[11] Patent Number: 4,910,066

[45] Date of Patent: Mar. 20, 1990

[54] REINFORCED PAPER AND METHOD FOR MAKING THE SAME

[75] Inventor: Robert A. Foisie, Carson City, Nev.

[73] Assignee: MRI Management Resoures, Inc., Windham, N.H.

[21] Appl. No.: 263,114

[22] Filed: Oct. 26, 1988

[51] Int. Cl.[4] ..... B32B 3/10; B32B 3/02; B05D 5/00

[52] U.S. Cl. ..... 428/137; 427/285; 427/286; 427/288; 428/192; 428/211

[58] Field of Search ..... 427/285, 286, 288; 428/137, 192, 211

[56] References Cited

U.S. PATENT DOCUMENTS

| | | | |
|---|---|---|---|
| 1,794,492 | 3/1931 | Rendall | 428/194 |
| 2,039,752 | 5/1936 | Thomas | 402/79 |
| 2,152,012 | 3/1939 | Albion | 428/189 |
| 2,375,582 | 5/1945 | Pitt | 402/79 |
| 3,479,203 | 11/1969 | Broadhurst | 427/285 |
| 3,912,835 | 10/1975 | Uchida | 427/316 |
| 4,025,671 | 5/1977 | Creamer | 427/286 |
| 4,234,635 | 11/1980 | Atkinson | 428/80 |
| 4,354,890 | 10/1982 | Maffey | 156/264 |
| 4,551,374 | 11/1985 | Holmberg | 428/43 |
| 4,617,223 | 10/1986 | Hiscock et al. | 428/211 |
| 4,718,883 | 1/1988 | Schmidt | 493/328 |

FOREIGN PATENT DOCUMENTS

| | | |
|---|---|---|
| 553923 | 7/1932 | Fed. Rep. of Germany . |
| 1086451 | 10/1967 | United Kingdom . |

OTHER PUBLICATIONS

BASF Corp. Paper Colors & Chemicals Dept.–Preliminary Technical Bulletins on "Luredur" NB 25 and AS-10.

Engurau, C. and Ruyo, R. de., "Influence of Polymer Properties and Deposition Technique on Mechanical Properties of Paper and Polymer Combinations", Mar. 1976–Abstract from File 240 on Dialog–Paper Chem covers 1967–date, paper technology.

James, T. W., "Improving Quality and Reducing Costs in Fastening Continuous Business Forms Through the use of Macrowave TM Technology", Sep. 18, 1981 Millis, MA, Radio Frequency Company, Inc.

"Care and Maintenance of . . . Pumps," Bulletin #M-1 by Nichols-Zenith Division of Parker.

*Primary Examiner*—Evan Lawrence

*Attorney, Agent, or Firm*—Mattern, Ware, Stoltz & Fressola

[57] ABSTRACT

A reinforced paper and method for making the paper. The method involves applying to finished paper or the areas of finished paper to be reinforced a reinforcing medium dissolved in water with a surface tension reducing agent added. The solution rapidly impregnates the paper and the water and surface tension reducing agent are subsequently evaporated. The reinforcing medium rearranges the bonding of the fibers in the paper, thus strengthening the paper. The process may be carried out at the line speeds of paper converters and, when only certain areas of the paper are reinforced, the reinforced areas have a thickness substantially the same as the unreinforced areas. A preferred reinforcing medium is an anionic acrylic copolymer.

18 Claims, 4 Drawing Sheets

REINFORCED PAPER AND METHOD FOR MAKING THE SAME

BACKGROUND OF THE INVENTION

1. Field of the Invention

The present invention relates generally to reinforcing paper generally and, more particularly, to a novel method and means for reinforcing paper which allows application of the reinforcing medium at paper converter line speeds and which results in a selectively reinforced paper in which the paper in the reinforced areas is essentially no thicker than the paper in the unreinforced areas. A particular application is in the production of reinforced, punched filler paper.

2. Background Art

Reinforcement of paper may be of two types: reinforcement of the entire paper or reinforcement of selected areas of the paper. The former type of reinforcement employing starch as the reinforcing medium is ancient and today synthetic polymers are being used in place of starch. The latter type of reinforcement is of particular interest where such paper articles as file cards and filler paper are provided with file holes which mate with holding devices such as loose-leaf binders. Such file holes tend to wear with time and eventually the card or paper may even pull away from the holder. Various mechanical means for reinforcing paper are old and include adhering tabs or strips of metal, fabric, polymeric material, or the like around the file holes or in the area in which the file holes are to be formed. Cards and papers incorporating these mechanical means are generally expensive to manufacture.

A particular disadvantage of mechanical reinforcements placed along one edge of the paper is that a stack of such reinforced paper is thicker on one side, thus rendering it difficult or impossible to properly feed a stack to modern high-speed copiers, computer printers, and the like and potentially causing mechanical problems within such devices. Also, such high-speed devices have heating sections which reach temperatures of 400–420 degrees Fahrenheit, which temperatures can partially melt and distort plastic reinforcements and destroy certain adhesives used to attach mechanical reinforcements. Also, some types of mechanical reinforcements make economical recycling of the paper impossible.

Chemical means of selective reinforcement have been attempted. Some involve the selective placement of a surface coating on paper in the areas which have file holes or in which file holes are to be formed. Such coatings add to the thickness of the paper in the reinforced areas and lead to the problems described above. Other chemical means impregnate the paper with polymeric materials which harden the paper and thus make it unsuitable for some applications such as filler paper. Many chemical methods of selective reinforcement cannot be carried out at the line speeds of paper converters. Many employ environmentally objectionable compounds. Some cannot be applied to low-grade, moisture-sensitive papers. Most employ chemicals not compatible with chemicals already used in paper making. There is no known chemical reinforcement process being used commercially to manufacture filler paper having reinforcement in the areas of the file holes.

Accordingly, it is a principal object of the present invention to provide a method and means for reinforcing paper which adds essentially no thickness to the paper in the areas of reinforcement.

Another object of the invention is to provide such a method and means which way be carried out at the line speeds of paper converters.

An additional object of the invention is to provide such a method and means which may be applied to low-grade, moisture-sensitive papers.

A further object of the invention is to provide a reinforcing process which may be carried out at room temperature.

Yet another object of the invention is to provide a reinforcing process which is economical and environmentally satisfactory.

Yet an additional object of the invention is to provide a reinforced punched filler paper which may be fed in stacks to high-speed copiers, computer printers, and the like.

Other objects of the invention, as well as particular features and advantages thereof, will, in part, be apparent and will, in part, be obvious from the following description and the accompanying drawing figures.

SUMMARY OF THE INVENTION

The present invention accomplished the above objects, among others, in a preferred embodiment, by applying to finished paper or the areas of finished paper to be reinforced a reinforcing medium dissolved in water with a surface tension reducing agent added. The solution rapidly impregnates the paper and the water and surface tension reducing agent are subsequently evaporated. The reinforcing medium rearranges the bonding of the fibers in the paper, thus strengthening the paper. The process may be carried out at the line speeds of paper converters and, when only certain areas of the paper are reinforced, the reinforced areas have a thickness substantially the same as the unreinforced areas. A preferred reinforcing medium is an anionic acrylic copolymer.

DESCRIPTION OF THE PREFERRED EMBODIMENTS

Figure 1:
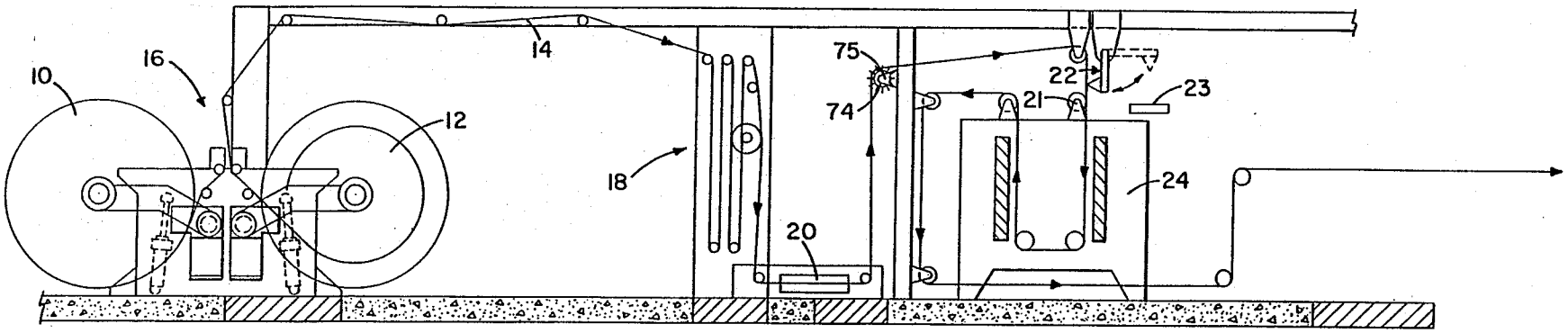
FIG. 1 is a side elevation view of a portion of a paper converting operation including the present invention.

A suitable reinforcement medium for practicing the present invention has been found to be acrylic copolymer, especially "Luredur" NB 25 and/or "Luredur" AS 10, both manufactured by BASF and furnished as 25 and 10 volume percent aqueous solutions, respectively. These materials increase all strength properties of paper, e.g., dry breaking strength, busting strength, pick strength, and CMT value. These types of materials are presently added to paper during manufacture before the paper is calendered, but only enough is used to obtain the minimum advertised paper strength and the entire paper is strengthened. In accordance with the present invention, when these materials, as supplied, are applied to dry paper, it is found that there is little, and very slow, penetration; therefore, the materials are preferably applied in a relatively dilute water solution which enhances the penetration and absorption of the materials.

The solution is spread on the paper in the areas to be reinforced, the paper is temporarily weakened, the water is evaporated, and the reaction of the reinforcing medium is completed. Because of the strong polar nature of the reinforcing materials, they form hydrogen bridges with the cellulose molecules, resulting in a reinforcement of the bond between the individual fibers and, hence, an increase in the dry strength of the paper. The material forms a tough film which adheres to the cellulose fibers. Application of high temperatures to effect curing is unnecessary because, unlike certain materials such as melamine or urea resins, the product is a high polymer which undergoes no further reactions. These materials are additionally advantageous over others because they can be removed easily in the effluent treatment facilities of repuleing plants.

While the application of the reinforcing medium in water solution produces a satisfactorily reinforced product, it requires a relatively high concentration of water and long drying times. It is essential when treating paper at the line speeds of paper converter plants, i.e., on the order of as much as 1600 feet per minute, that the material quickly penetrate the paper and that the water be quickly removed. It has been found that accelerated penetration is achieved by the addition of a surface tension reducing agent. A particularly advantageous surface tension reducing agent is isopropyl alcohol which is a relatively innocuous material already in current use in wet offset and flexographic printing operations such as in printing the lines commonly found on filler paper; therefore, operational personnel are familiar with handling it and it would normally already be present in the facility. Use of isopropyl alcohol also facilitates evaporation of the water, since those two materials form a minimum-boiling-point azeotrope. Other suitable agents which reduce the surface tension of water may be employed as well and such is within the intent of the present invention.

A satisfactory solution for application at high line speeds comprises:

| | |
|---|---|
| | "Luredur" NB 25<br>20–30 volume percent* |
| Isopropyl alcohol | 25 volume percent |
| Ink concentrate | Less than 5 volume percent |
| Water | Balance |

*(of 25 volume percent solution as furnished by the manufacturer, or 5–7.5 volume percent of copolymer.)

"Luredur" AS 10 may be substituted for "Luredur" NB 25, in the above proportions, in which case, the volume of polymer in the final solution would be 2–3 percent. Although higher polymer concentrations may be employed little further improvement is realized from increasing the concentration in the above formula to much over 30 volume percent.

Luredur AS 10 and NB 25 are anionic acrylic copolymers produced by BASF Corporation Chemicals Division, 100 Cherry Hill Road, Parsippany N.J.

The ink is not required, but is desirable because it allows the consumer to detect that the paper is reinforced. When used, the ink is preferably a flexographic printing ink.

The concentration of isopropyl alcohol may be from an effective amount up to about 30 volume percent and is preferably in the range of from about 20 to about 30 volume percent. Above 30 volume percent, the alcohol tends to cause the "Luredur" to coagulate and, for this reason, the alcohol should be added after the "Luredur" and the water are mixed. The minimum amount of isopropyl alcohol depends on the line speed, with no alcohol being required at low line speeds, say, on the order of 200–300 feet per minute, although the alcohol does assist in the initial breaking down of the fiber bonds in the paper.

The above solution is preferably deposited in a layer on the order of from about 0.0003 inch to about 0.0010 inch wet thickness, with the maximum strength increase (in the range of 30–55 percent) occurring with a wet thickness range of about 0.0005–0.0006 inch. Thicker deposition does not appreciably increase strength improvement. Thickness of application depends somewhat on the weight and type of paper to be treated. A minimum application thickness of about 0.0003-inch wet on 18-lb. paper (17"×22"- 500 sheets) containing alum produces satisfactory results. Papers not containing alum may require somewhat more to optimize results.

While the above thicknesses provide satisfactory reinforcement when applied to one surface of the paper, it is also within the intent of the invention to apply approximately one-half those thicknesses to each surface of the paper in the area to be reinforced. A particular advantage of this method is that the time required for penetration of the material is approximately halved.

The method of the present invention may be carried out on line in a conventional printing and cutting operation in a paper converting plant. FIG. 1 shows part of such an operation which includes feed rolls 10 and 12 of finished paper which supply paper 14 to a splicer 16. When the paper on one roll, say, roll 12 is exhausted, splicer 16 splices the beginning of the paper on roll 10 to the end of the paper on roll 12 and roll 12 is then replaced with a full roll. From splicer 16, the paper passes to a festoon accumulator 18 which provides capacitance in the system to allow for discontinuous and variable-speed operations in the feeding, printing, punching, and cutting operations and which controls unwind brakes (not shown) on feed rolls 10 and 12 to maintain a selected web tension.

As paper 14 leaves festoon accumulator 18, it passes through an edge guide 20 which areas that the side of the paper will be properly registered for the application of the reinforcing medium. Paper 14 then passes against a pivotable extrusion nozzle assembly 22 which deposits a layer of reinforcing solution (not shown) on the paper. After deposition of the reinforcing solution, paper 14 passes through dryer 24 where water and surface tension reducing agent are removed.

Disposed on the side of paper web 14 opposite that of extrusion nozzle assembly 22 is an adjustable roller 21 which controls web-to-nozzle position. Extrusion nozzle assembly 22 is shown (solid) in position to apply solution to paper web 14. When not applying solution, extrusion nozzle assembly 22 is located as shown (dashed) over a drip pan 23.

Splicer 16 and festoon accumulator 18 are conventional machines used in paper printing and cutting operations. Extrusion nozzle assembly 22 may be of the type commonly used in cold glue application processes.

Although dryer 24 may be of any type, it has been found that it preferably be of the radio-frequency type. Hot air dryers tend to shrink the non-treated areas of the paper and cause warpage. A radio-frequency dryer acts by exciting the water molecules directly and therefore requires less heating of the paper without undue shrinkage thereof. This advantage means that the invention may be applied to low-grade papers that are very moisture sensitive. There will, of course, be some minor shrinkage even with a radio-frequency dryer. At relatively low line speeds, say, on the order of less than 300 feet per minute, no dryer may be required depending on the thickness of the applied solution, since ambient temperature in such operations is sufficient to remove the water and the surface tension reducing agent. With such a scheme, it is necessary to provide for venting the evaporated surface tension reducing agent from the production area. It will be obvious that venting (not shown) must also be provided for dryer 24. If no dryer is used, however, the treated areas can develop a rough surface that may be objectionable in certain applications. Also, wrinkles tend to form at web idler rollers unless the moisture in the treated areas is reduced to nearly the relative humidity of the untreated areas of the paper before the moisture swells the paper fibers. Above 300 feet per minute, application of the solution without a dryer is not recommended; although, using several heat lamps may permit speeds up to about 500 feet per minute. Above 500 feet per minute, a radio-frequency dryer should be used.

A further advantage of the radio-frequency dryer is that the excitation of the water molecules tends to promote mobility of the solution and promotes penetration into the paper and, therefore, helps to enable use of the invention at high line speeds. In some applications, this promotion of penetration may be sufficiently high that no surface tension reducing agent is required. The high speed of the process and the rapid removal of water means that the water is removed before it has time to swell the paper fibers. In one test, a wet application thickness of 0.0012 inch dried in less than 1 second and a thickness of 0.0006 dried in less than 0.5 second. Such dryers are manufactured, for example, by the Radio Frequency Company, Inc., 150 Dover Rd, Millis, Mass.

An extrusion system is preferred for deposition of the solution, since the thickness of the wet solution deposited is greater than can be applied by known printing methods such as transfer wheel, rollers, or patterned cylinders; although, with thin applications, the latter methods may be satisfactory, especially when the solution is applied on both sides of the paper 14. An advantage of the extrusion system is that, until the solution is applied to paper 14, the solution can be completely sealed from air and thus no periodic viscosity checks or adding of make-up fluids to compensate for evaporation are required, as would be typically required with an open application system. In most cases, a plurality of extrusion nozzle assemblies 22 would be provided across the paper, the number of extrusion nozzle assemblies depending on the width of the paper and the number of stripes of reinforcement across the width of paper 14. Stripe width is typically on the order of $\frac{5}{8}$–$\frac{7}{8}$ inch depending on the diameter of the file hole used.

Figure 2:
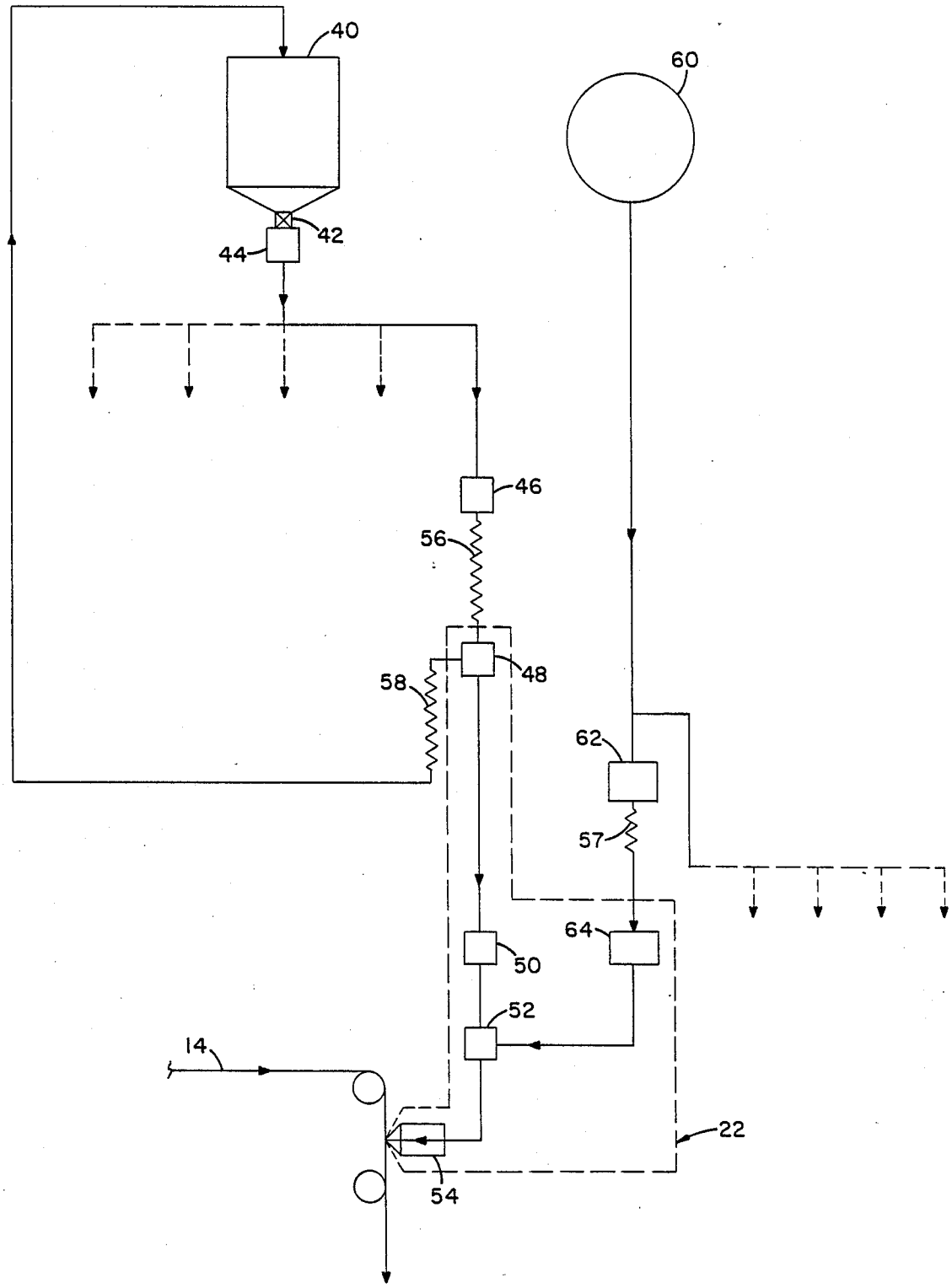
FIG. 2 is a schematic flow diagram of the extrusion system of the present invention.

FIG. 2 is a schematic diagram of the extrusion system of the present invention or applying the reinforcing solution to the paper web 14 and includes the extrusion nozzle assembly 22 shown applying the solution (not shown)to paper web 14. Solution is supplied from tank 40 through shutoff valve 42 and filter 44. A gear pump 46 provides the motive force to the solution and from the gear pump, the solution flows through a three-way bypass return valve 48, through a check valve 50, through a selector valve 52, and to an extrusion slot assembly 54, the latter elements being part of extrusion nozzle assembly 22. Tank 40 may provide solution to other gear pumps and bypass return valves (not shown) if other extrusion nozzle assemblies (not shown) are used.

Flushing solution is furnished from pressurized tank 60, pressurized by conventional mans (not shown), through shutoff valve 62 and check valve 64 to selector valve 52, with check valve 64 being part of extrusion nozzle assembly 22. As indicated, flushing solution may also be supplied to other extrusion nozzle assemblies (not shown) from pressurized tank 60.

Connections to extrusion nozzle assembly assembly 22 from gear pump 46 and shutoff valve 62 are through flexible hoses 56 and 57, respectively, and connection from the extrusion nozzle assembly assembly to tank 40 is through flexible hose 58. Flexible hoses 56–58 permit extrusion nozzle assembly 22 to be pivoted between the "on" and "off" positions.

In operation, it may be assumed first that paper web 14 has not yet begun movement, but that extrusion nozzle assembly 22, is in the position shown dashed on FIG. 1. In this state, gear pump 46 is started but bypass return valve is set to recirculate the solution to tank 40. When paper web 14 begins to move and reaches a predetermined speed, extrusion nozzle assembly 22 automatically pivots into position against the paper web and three-way bypass return valve 48 switches to its non-bypassing position to allow solution to be fed to extrusion slot assembly 54 through selector valve 52.

If the movement of paper web 14 ceases for a predetermined length of time, perhaps on the order of several seconds, due, for example, to periodic shutdown of the line or mechanical failure, three-way bypass return valve 48 automatically switches to its bypassing position, extrusion nozzle assembly 22 pivots to the position shown dashed on FIG. 1 and shutoff valve 62 is turned on and selector valve 52 switches its position to allow flushing solution to flow through extrusion slot assembly 54 for a predetermined period of time to prevent clogging of the nozzle. The pushing fluid is preferably of the type that is miscible with water and will not quickly dry when exposed to air, such as a liquid detergent.

Figure 3:
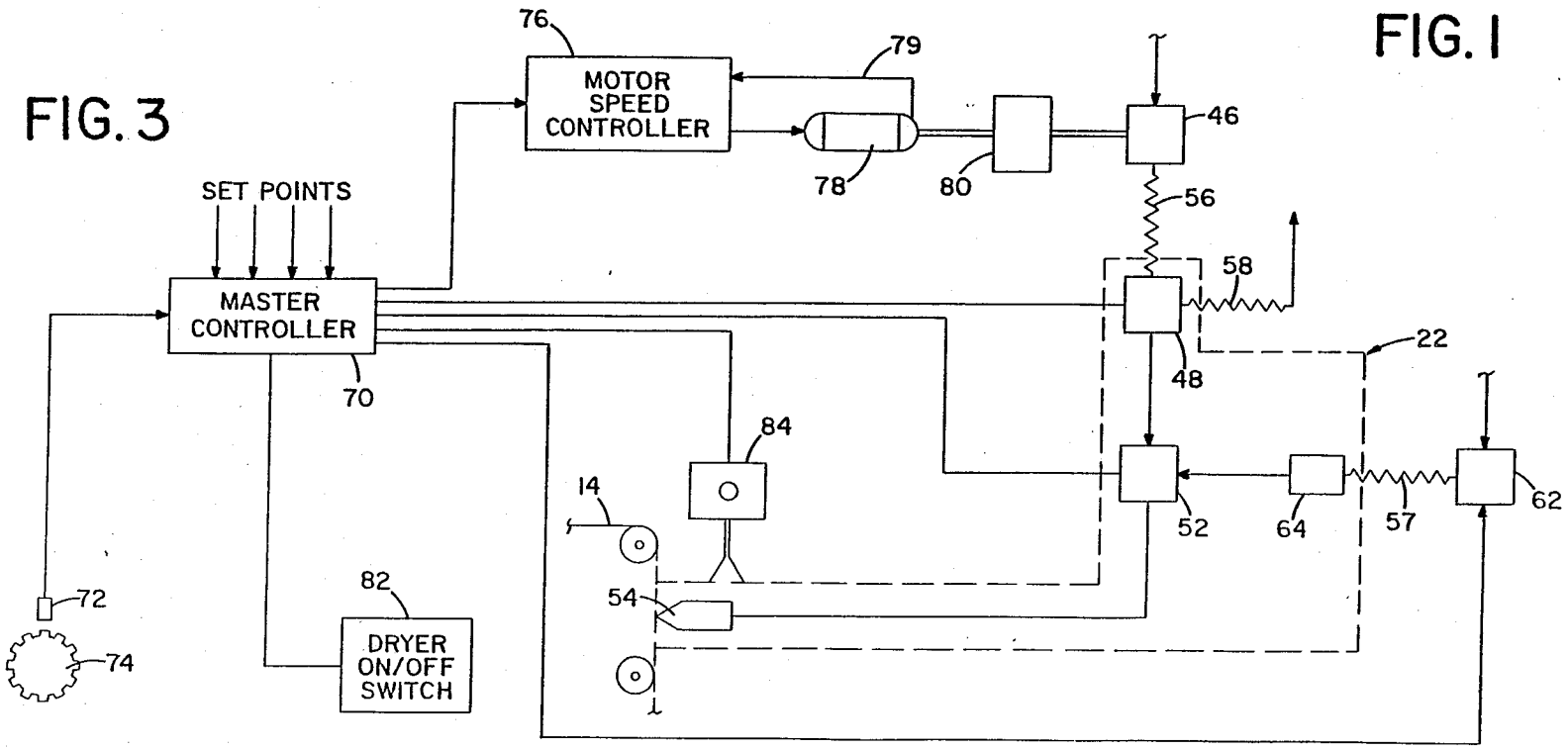
FIG. 3 is a schematic diagram of the control system of the present invention.

FIG. 3 illustrates a control system for use with the embodiment of the present invention described above and includes a master controller 70, preferably a programmable microprocessor, which receives a digital reference signal indicating speed of the paper processing machine from a magnetic pick-up 72 mounted to the machine to count gear teeth on a machine-mounted gear 74 which may, for example, be mounted on a common axle with idler roller 75 (FIG. 1). Master controller 70 receives set point inputs which may include such parameters as the amount of solution to be applied per unit length of paper and the time interval between the stopping of paper motion and switching of the extrusion system to its "off" position Depending on the amount of solution to be applied, master controller 70 provides a set point input to motor speed controller 76 which controls servomotor 78, with the servomotor providing encoder feedback to the motor speed controller on lead 79. Servomotor 78 drives gear pump 46 through gear box 80, which provides a solution flow in direct proportion to web speed to assure uniform application of the coating material. If other extrusion nozzle assemblies are included in the same system, the pumps feeding those may also be driven from gear box 80 (other pumps not shown).

Master controller 70 is also connected to bypass three-way return valve 48, selector valve 52, and shut-off valve 62 to control the functions of those valves and is connected to a torquer motor 84 which effects movement of extrusion nozzle assembly 22 between its "on" and "off" positions.

Master controller 70 may also control dryer on/off switch 82 and may provide other functions, such as indicating material usage from tank 40, with a low level alarm.

Gear pump 46, motor speed controller 76, servo motor 78, and gear box 80 may be the Series BPB with Automatic Speed Command, by Nichols-Zenith Division, Parker Hannifin Corp., 48 Woerd Ave., Waltham, Mass., which provides a precision positive displacement pump with an internal protective coating to handle materials with low lubricity. This system will permit gear pump 46 to follow web speed with a maximum error of ¼ percent from 1/20 of rated machine speed to maximum rated machine speed.

The application system can be added to existing machinery with minimum difficulties, especially when operating speeds are such that a dryer is not required, all else being required are a web edge guide, an extrusion system, and necessary idler rolls.

Figure 4:
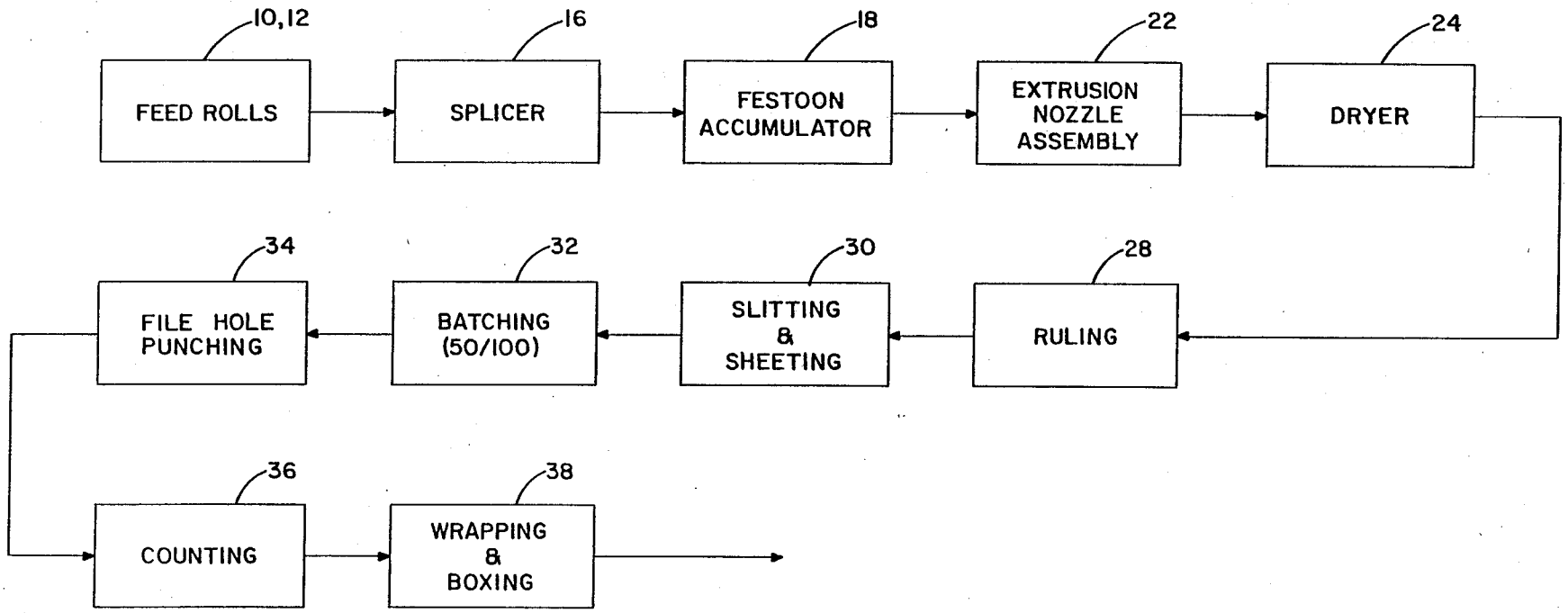
FIG. 4 is a block diagram of a typical paper converter line of which the present invention may be a part.

FIG. 4 is a block diagram showing a typical paper converter line including the present invention, indicating the various operations within the line. The finished paper web moves from feed rolls 10 and 12, through splicer 16 and festoon accumulator 18, past extrusion nozzle assembly 22 where reinforcing solution is applied, and through dryer 24 where water and any surface tension reducing agent are removed, all as described above in more detail with reference to FIG. 1. After chill roll 26, the paper web moves to a ruling station 28 where lines are printed on the paper, if the paper is to be ruled. Following ruling, the paper web moves to a slitting and sheeting station 30 where the web is cut lengthwise and widthwise to form the sheets of paper. The sheets of paper are passed to a batching operation 32 where stacks of perhaps 50 or 100 are formed, which stacks are then moved to a file hole punching station 34 where the file holes are formed. The number of sheets in a stack depends on the thickness of the paper and the capabilities of file hole punching station 34. Following punching the punched stacks move to a counting operation 36 where they are placed in stacks of the numbers in which they will be sold, say 200 or 500 sheets. The final stacks then are wrapped and boxed at station 38, following which the boxes may be warehoused or shipped.

Figure 5:
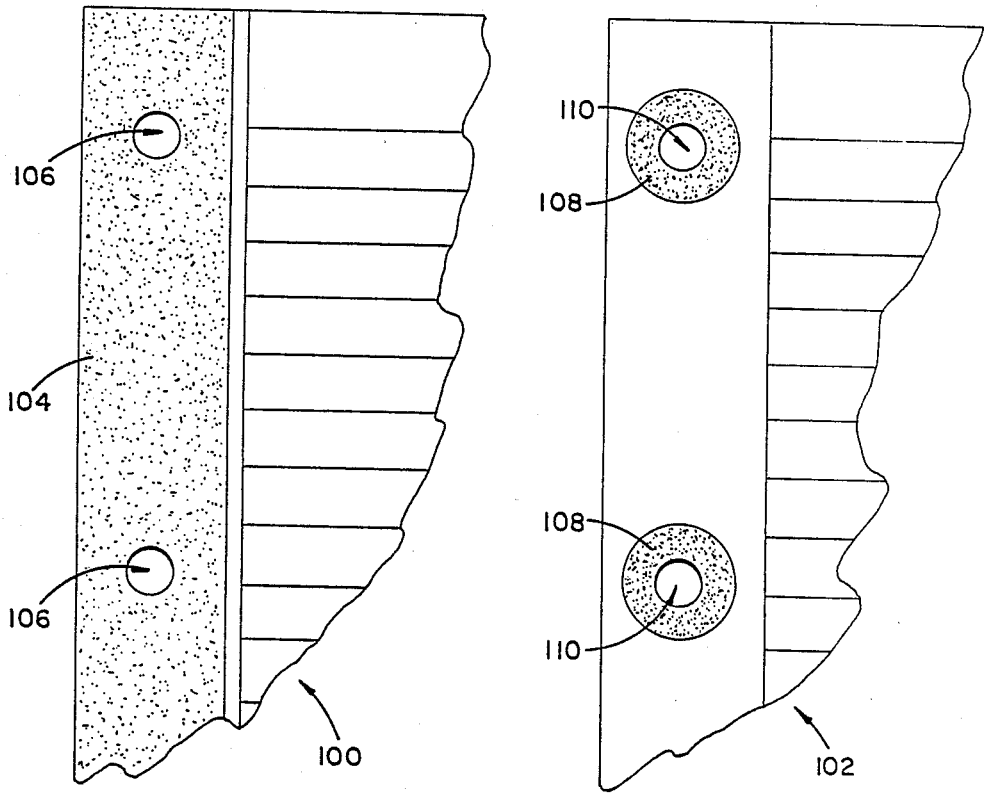
FIG. 5 shows fragmentary plan views of punched filler paper reinforced according to the present invention.

FIG. 5 shows fragmentary plan views of punched filler paper, generally indicated by the reference numerals 100 and 102, reinforced according to the present invention. Paper 100 is an embodiment of the invention which includes a reinforced stripe 104 along one edge of the paper, formed by the application of the reinforcing solution described above, the stripe being visible because the reinforcing solution included an ink. The stripe is located in the general are where file holes 106 were, or were to be, formed.

Paper 102 is an embodiment of the invention which includes reinforced areas 108, including an ink. The reinforced areas 108 are located in the immediate areas where file holes 110 were, or were to be, formed. It will be understood that the annular reinforced areas 108 cannot be provided with an extrusion application system as described above, but could, for example, be provided with application on both sides of the paper with patterned cylinders.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A method of reinforcing a selected area of finished paper, comprising:

(a) providing a finished paper;

(b) providing a reinforcing solution, comprising:

(i) an anionic acrylic copolymer; and (ii) water;

(c) applying said reinforcing solution to said selected area of said paper to impregnate said selected area of said paper with said solution; and (d) then drying said paper removing the water from said applied solution; thereby reinforcing said selected area by means of said copolymer and leaving said selected area with the thickness thereof substantially the same as unreinforced areas of said paper.

2. A method, as defined in claim 1, wherein said anionic acrylic copolymer is present in the range of from an effective amount up to about 7.5 volume percent.

3. A method, as defined in claim 1, wherein said anionic acrylic copolymer is obtained from a composition selected from the group consisting of "Luredur" NB 25 and "Luredur" AS 10.

4. A method, as defined in claim 1, wherein said reinforcing solution further comprises a surface tension reducing agent to accelerate penetration of said polymer into said paper, which agent is remove in step (d).

5. A method, as defined in claim 4, wherein said surface tension reducing agent comprises isopropyl alcohol.

6. A method, as defined in claim 4, wherein said surface tension reducing agent is present in the range of from an effective amount up to about 30 volume percent.

7. A method, as defined in claim 1, wherein said reinforcing solution further comprises an ink.

8. A method, as defined in claim 7, wherein said ink is present in a concentration of up to about 5 percent volume percent.

9. A method, as defined in claim 7, wherein said ink is a flexographic ink.

10. A method, as defined in claim 1, wherein said reinforcing solution is applied in a total wet thickness of from about 0.0003 inch to about 0.0010 inch.

11. A method, as defined in claim 1, wherein said reinforcing solution is applied in a total wet thickness of from about 0.0005 inch to about 0.0006 inch.

12. A method, as defined in claim 1, wherein said solution is applied to said selected area of paper with an extrusion nozzle assembly.

13. A method, as defined in claim 1, wherein said drying is accomplished in a radio-frequency dryer.

14. An article produced by the method of claim 1.

15. An article, as defined in claim 14, wherein said article comprises punched filler paper having at least the areas around the file holes thereof reinforced.

16. A reinforced paper, comprising a sheet of paper having at least one selected area thereof internally reinforced with an anionic acrylic copolymer, said at least one selected area having a thickness substantially the same as unreinforced areas of the paper.

17. A reinforced paper, as defined in claim 16, wherein said anionic acrylic copolymer is obtained from a composition selected from the group consisting of "Luredur" NB 25 and "Luredur" AS 10.

18. A reinforced paper, as defined in claim 16, wherein said paper comprises reinforced filler paper having at least the areas around the file holes thereof reinforced.

* * * * *

UNITED STATES PATENT AND TRADEMARK OFFICE

CERTIFICATE OF CORRECTION

PATENT NO. : 4,910,066

DATED : March 20, 1990

INVENTOR(S) : Robert A. Foisie

It is certified that error appears in the above—identified patent and that said Letters Patent is hereby corrected as shown below:

In the Specification:

Column 2, line 25, "accomplished" has been changed to --accomplishes--.
Column 2, line 62, "busting" has been changed to --bursting--.
Column 3, line 21, "repuleing" has been changed to --repulping--.
Column 4, line 50, "areas" has been changed to --assures--.
Column 5, line 65, "or" has been changed to --for--.
Column 6, line 12, "mans" has been changed to --means--.
Column 6, line 46, "pushing" has been changed to --flushing--.
Column 7, line 67, "are" has been changed to --area--.

In the Claims:

Column 8, line 35, after "paper --by-- has been added.
Column 8, line 62, "percent" has been deleted.

Signed and Sealed this

Twenty-sixth Day of March, 1991

*Attest:*

HARRY F. MANBECK, JR.

*Attesting Officer*

*Commissioner of Patents and Trademarks*